United States Patent [19]

Chisum

[11] 4,126,977

[45] Nov. 28, 1978

[54] CONTOUR OF LOG CABIN LOGS FOR OPTIMUM SEAL

[76] Inventor: Finis L. Chisum, P.O. Box 1145, Claremore, Okla. 74017

[21] Appl. No.: 822,801

[22] Filed: Aug. 8, 1977

Related U.S. Application Data

[63] Continuation-in-part of Ser. No. 678,238, Sep. 13, 1977, Pat. No. 4,047,350.

[51] Int. Cl.[2] ..... E04C 1/10; E04B 1/10

[52] U.S. Cl. ..... 52/233; 52/403; 52/595; 52/396

[58] Field of Search ..... 52/233, 595, 403, 396; 46/20

[56] References Cited

U.S. PATENT DOCUMENTS

| | | | |
|---|---|---|---|
| 634,562 | 10/1899 | Pagnon | 52/595 |
| 4,047,350 | 9/1977 | Chisum | 52/233 |

FOREIGN PATENT DOCUMENTS

| | | | |
|---|---|---|---|
| 476,660 | 9/1951 | Canada | 52/233 |
| 622,653 | 6/1961 | Canada | 52/403 |
| 41,122 | 3/1925 | Norway | 52/233 |
| 42,819 | 5/1926 | Norway | 52/595 |
| 1,338,575 | 11/1973 | United Kingdom | 52/233 |

*Primary Examiner*—James L. Ridgill, Jr.

*Attorney, Agent, or Firm*—Head, Johnson & Chafin

[57] ABSTRACT

An improved contour for logs which are to be assembled one on top of the other for producing walls, etc. for log cabins. The contour includes a pair of plain parallel surfaces, one on the top, and the other on the bottom of the log, as installed. In the preferred embodiment the top surface carries a pair of spaced parallel tongues of trapezoidal cross-section, and the bottom surface carries substantially a mirror image, in the form of two grooves which are adapted to fit over the tongues on the log immediately adjacent below. On either side of the tongues and grooves are two shelves which are approximately horizontal. However, on the top surface they slope at a small angle A downwardly from the horizontal, to their lips at the intersection with the outer contour of the log. Similarly, on the under side, the shelves slope downwardly at a slightly greater angle B so that when one log is placed on top of the other, the two lips will be in contact and will support the one log on top of the other, providing a high unit pressure to promote the exclusion of moisture through the contact.

10 Claims, 6 Drawing Figures

CONTOUR OF LOG CABIN LOGS FOR OPTIMUM SEAL

CROSS-REFERENCE TO RELATED APPLICATION

This Application is a continuation-in-part of my copending Application Ser. No. 678,238, now U.S. Pat. No. 4,047,350 issued Sept. 13, 1977 entitled "LOG PRODUCT AND IMPROVEMENTS IN MACHINE TO PREPARE LOGS FOR LOG HOUSES".

BACKGROUND OF THE INVENTION

1. Field of the Invention

This invention lies in the field of the manufacture of logs for use in assembling log houses or log cabins.

More particularly, it concerns the contouring on the top and bottom surfaces of the logs, so that in constructing a wall, by placing log upon log, the intervening contact surface between the logs will effectively seal against the intrusion of moisture from outside the structure.

2. Description of the Prior Art

In the prior art, various types of tongue-and-groove constructions have been supplied where the tongues and grooves extend outwardly and inwardly, respectively, from plane parallel surfaces. In general, the trees used for manufacturing logs for log houses are machined while they are still green. As they dry and weather they shrink and crack, etc. Consequently, two surfaces which might be precisely parallel and in contact when assembled, may provide a substantial gap between the surface after there is weathering and differential contraction, shifting, etc.

It is the purpose of this invention to provide a positive pressure contact at the outer extremities of the joint between the two logs, so that as the logs weather and shrink there will always remain a high unit pressure contact, to exclude the migration of moisture, inwardly into the joint.

SUMMARY OF THE INVENTION

It is a primary object of this invention to provide an improved type of joint in the contact surfaces by which two logs contact each other, when assembled vertically one above the other, in the construction of the wall of a log house.

It is another important object of this invention to provide a type of contact surface contour, such that the two logs are in contact at the lips of the two surfaces, that is, where the contact surfaces reach the outer contour of the log, so that there will always be a high unit pressure between the two logs at these lips, providing such a firm and intimate contact that migration of moisture through the contact is impossible.

These and other objects are realized and the limitations of the prior art are overcome in this invention by providing such a surface contact that ensures that there will be a positive high unit pressure contact between the top log and the bottom log at the lips of the shelves.

One of the important problems of sealing the logs of a log cabin lies in the requirement of providing a firm high pressure contact between the two logs under all conditions of construction and subsequent weathering, shrinkage and cracking of the logs, as they weather.

In a preferred embodiment, the contact surfaces comprise approximately flat horizontal surfaces on top and bottom of the originally cylindrical log. On the top surface two spaced parallel ridges extend upwardly, leaving two lateral shelves extending outwardly to lips at the junction with the cylindrical surface. The bottom surface is similar, except that it contains matching grooves to mesh with the ridges in the log below.

Whereas two logs on their contact surface might have their shelves precisely parallel and in contact when assembled, it will be clear that as the logs dry out, there will be differential shrinking and twisting which may permit the opening of a thin passageway in the contact, for the migration of moisture from outside the wall, and consequent passage into the joint, where the retention of moisture may cause deterioriation and rotting of the wood, etc.

In this invention the contact is designed to be at the outer surface of the logs, or at the lips of the shelves. The design is further made so that, if there is differential weathering, there will still be a principle support of the two logs at these lips, so that there will be high unit pressure, and intimate contact, to prevent the migration of moisture inwardly of the joint.

The tongues and grooves generally have a slightly tapered wall so that the meshing is simpler, and allows a certain freedom for lateral movement resulting from the splitting and deformation of the log as it weathers and dries.

The important part of this invention lies in the particular shape of the shelves on each side of the tongues and grooves, that extend out to the outer surface of the log. While these shelves are approximately horizontal, the design must be such that there is a downwardly and outwardly extending surface, with the slope a selected small angle, generally in the range of two to three degrees, on the top surface of the log.

On the bottom surface of the log the shelves have a slightly greater downward slope, which ensures that the two logs will always contact at the outer edge of the shelves, or at the lips of the shelves.

As the logs dry they shrink to a smaller radius, and consequently these angles will vary slightly as the logs dry. However, it is important that the angle be sufficient at the start, so that with the slight distortions, there will still be a resulting downward slope on the upper surface of the log and a greater downward slope on the under surface of the log to maintain the high unit pressure between the two logs at the outer extremeties of the shaped surfaces.

BRIEF DESCRIPTION OF THE DRAWINGS

These and other objects and advantages of this invention and a better understanding of the principles and details of the invention will be evident from the following description taken in conjunction with the appended drawings, in which.

DESCRIPTION OF THE PREFERRED EMBODIMENT

Figure 1:
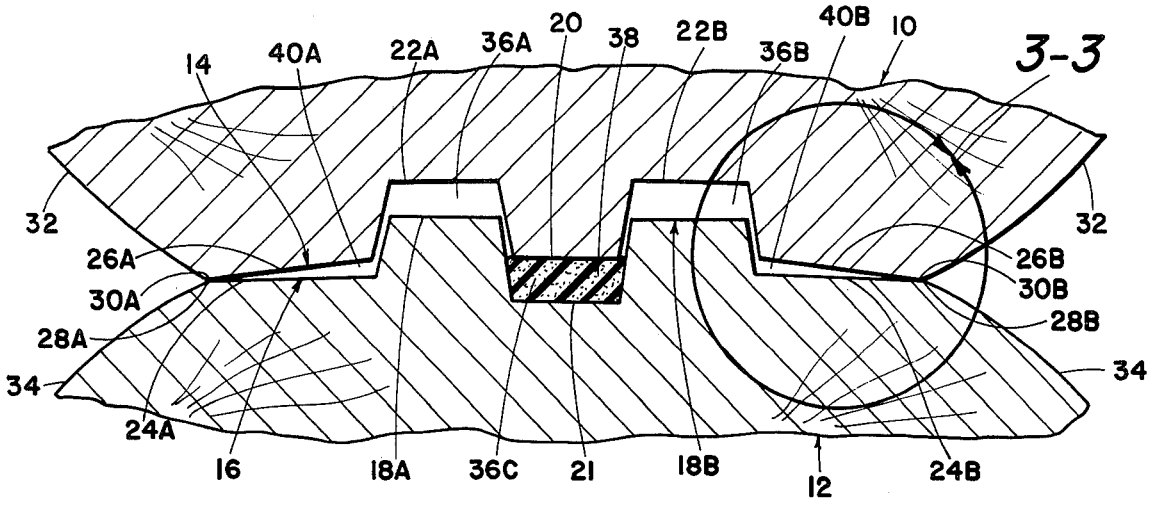
FIGS. 1 and 2 show in cross-section, the joint between two logs, vertically disposed, one with respect to the other.
Figure 2:
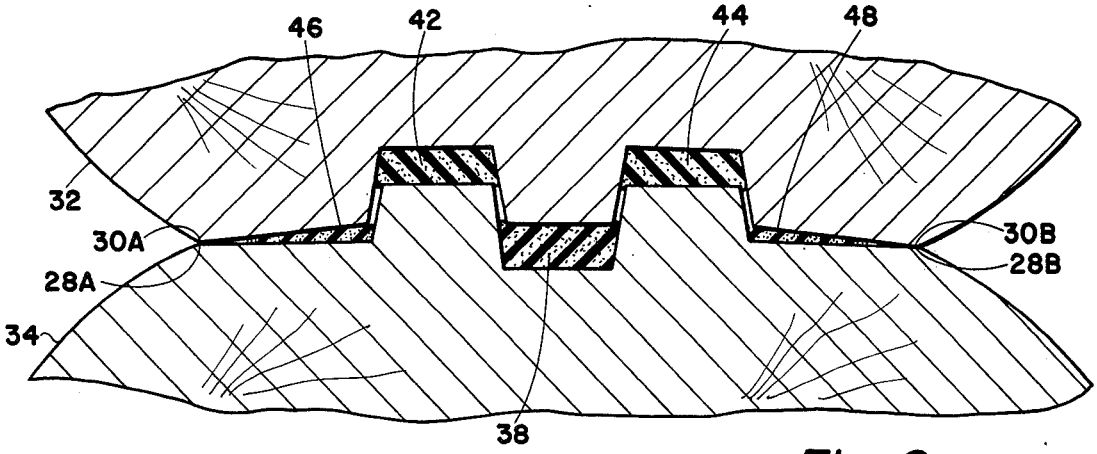
Figure 3:
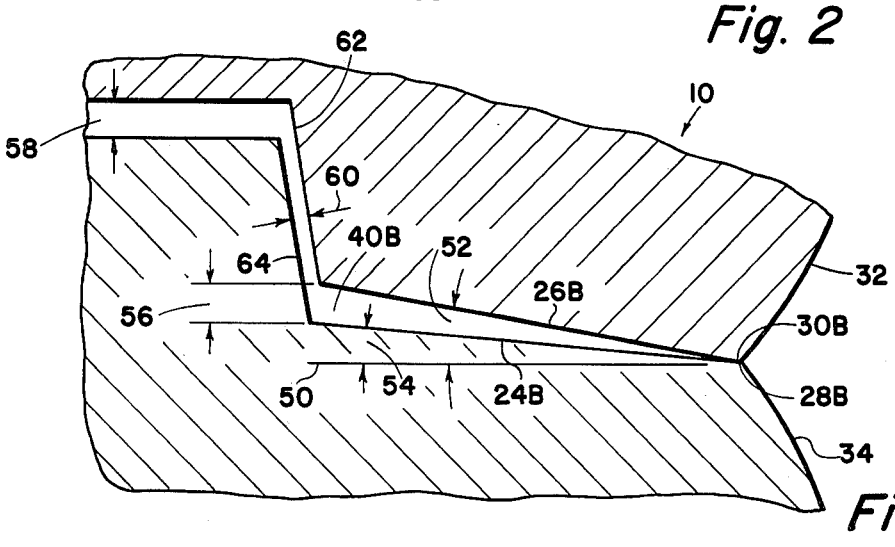
FIG. 3 shows an enlarged detail of the outer shelves of the contact surface between two logs, taken along the circle 3—3 of FIG. 1.

Referring now to the drawings and, in particular, to FIGS. 1, 2 and 3, there is shown a preferred form of contour, in the contact surfaces between an upper log 10 and a lower log 12, for assembly in a vertical wall of a log house or cabin.

The top surface 16 and bottom surface 14 are approximately plane horizontal surfaces, with spaced parallel tongues 18A, 18B extending upwardly from the top surface, and in the bottom surface of the log, there are correspondingly two spaced parallel grooves 22A, 22B which are substantially mirror images of the two tongues. On the outside of the tongues 18 and grooves 22 there are shelves 24, 26 extending laterally out to the outer surfaces 34, 32 of the logs. On the upper surface 16 of the log 12 these shelves 24A, 24B slope outwardly and downwardly at a selected small angle 54. In the bottom surface of the log, these shelves extend outwardly and downwardly at a greater selected small angle 52. The angle 54 of the top shelf will be generally labelled A, and of bottom shelf B, where B is greater than A. This is clearly indicated in FIG. 3 where 50 indicates the horizontal, 24B indicates the top shelf and 26B the bottom shelf.

The height of the tongues and depth of the grooves are such that there may be a space 58 between the two, when the logs are in position, so that additional sealing material can be inserted in one or more of the spaces as shown in FIGS. 1 and 2. There is also a small clearance 60 between the sloping walls of the tongues and grooves.

More importantly, however, because of the lack of pressure contact between the tongues and grooves, the major points of contact between the two logs lie in the lips 28A and 28B of the lower log 34, in contact with the lips 30A and 30B of the upper log 32. Because of the greater slope angle 52 of the shelves 26A and 26B of the undersurface 14, as compared to the slopes 54 of the shelves 24A and 24B of the lower surface 16, there will be a high unit pressure contact at the lips 28B, 30B, which will tend to slightly deform the wood of the logs, and to provide an intimate high-unit-pressure contact, which will exclude all moisture that might tend to migrate between the two logs into the interior space.

Preferably, the angle of slope 54 of the top shelf 24 is of the order of 2° to 3°, while the slope of the bottom shelf 26B is at least ½° to 1° larger, that is of the order of 3° to 4° of slope. This slope is made fairly substantial, in order that when these logs weather, dry, and shrink, in radial dimension, and when they vary slightly because of cracking, which is a natural phenomenon of these logs as they dry, there will still be a resultant differential angle between these two shelves 24, 26, so that the points of contact at the lips 28, 30 will remain, irrespective of the degree of drying of the log.

As shown in FIGS. 1 and 2, the base 21, between the two tongues 18A, 18B, can be substantially in the plane of the shelves 24A, 24B, or above the plane, or, as illustrated, below the plane. Thus, spaces can be provided for sealing material.

As shown in FIG. 1, it is possible to provide a thin strip 38 of selected foamed plastic material in at least one of the spaces 36C, or as in FIG. 1, in each of the three spaces 36A, 36B, 36C, with corresponding strips 38, 42, and 44. These are compliant enough so that they do not prevent the contact and high pressure at the lips 28 and 30, of the two logs.

In addition, if desired, a plastic caulking material, indicated by numerals 46 and 48, can be provided in the cavities 40A and 40B between the two sets of shelves in the contact surfaces of the logs. Thus, not only will there be the high-unit-pressure contact and seal at the lips 28, 30 but also the sloping surfaces of the upper shelves 24, and the cavities 40 can be filled tightly with compressed caulking material.

Because of the tapered nature of the tongues and grooves, there will be a gap between the walls of the tongues and grooves providing a nominal clearance of possibly 1/16 of an inch so that excess caulking material in the cavities 40 can be extruded upwardly into the gap between the walls of the tongues and grooves. This caulking compound should, of course, be a non-drying, flexible, extrudable material that is water-repellent.

In FIG. 3, the angle 54, or angle A, between the shelf 24B and the horizontal 50 is preferably in the range of 2° to 3° and angle 52, or angle B between the shelf 26B and the horizontal is greater by ½° to 1° or a total angle of from 2.5° to 4°. The differential angle (B-A) between the shelf 24B and the shelf 26B is preferably of the order of ½° to 1°, which provides a leeway for differential shrinkage of the material, still maintaining a slightly tapered cavity 40B between the two shelves on each side of the log.

Figure 4:
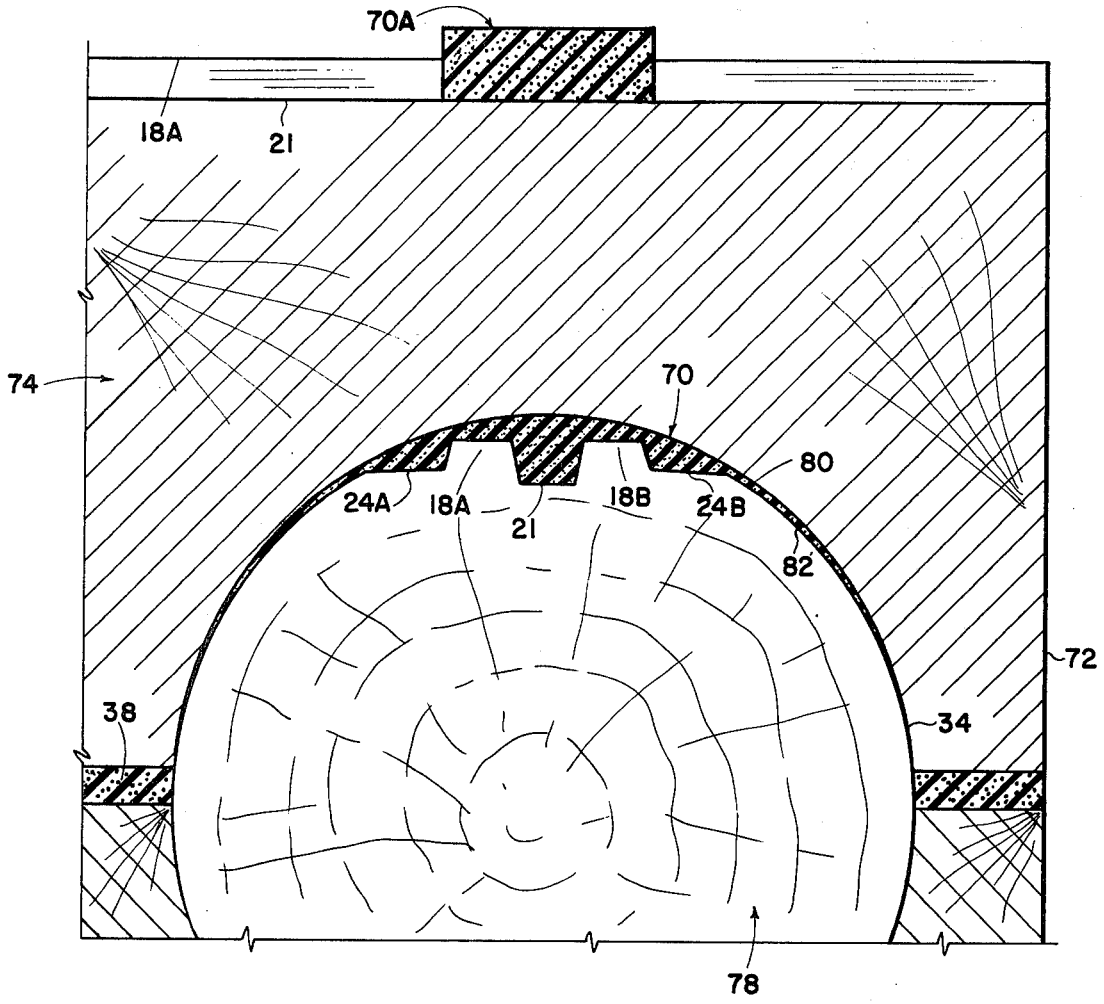
FIGS. 4 and 5 show two views of a corner joint between two logs illustrating the method of sealing one log with respect to the other.
Figure 5:
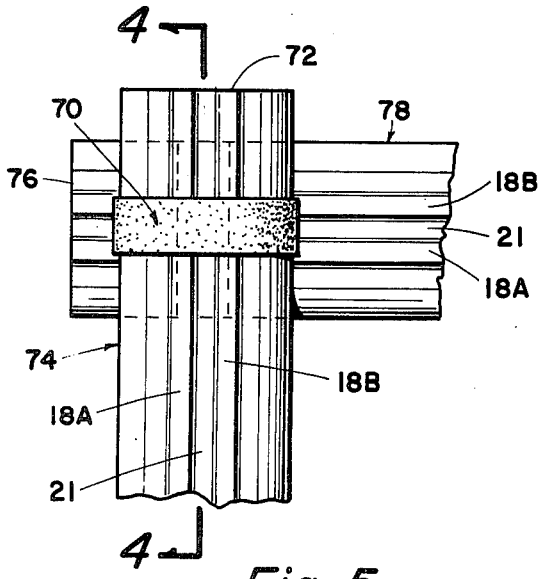

Referring now to FIGS. 4 and 5 in the construction of log cabins where two walls intersect in a corner, it is customary to provide for the cylindrical logs a semi-cylindrical cavity on the underside of one log, the cavity being of a radius equal to that of the outer contour of the log. Thus, when one log crosses the other, the semi-cylindrical cavity will fit snugly over the contour of the cross log.

Figure 6:
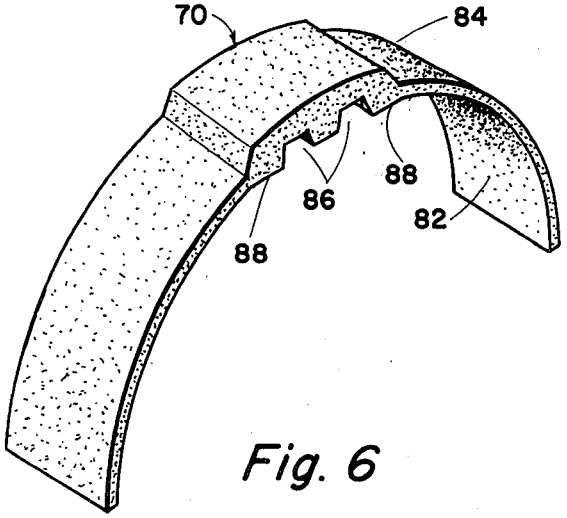
FIG. 6 illustrates a sealing member which can be used to provide the seal indicated in FIGS. 4 and 5.

However, because the top surface of the log has been machined to provide the tongue members, groove members, and shelf members, the outer contour will not be a complete semi-cylinder. Therefore, it is important to provide a sealing member such as illustrated in FIG. 6, indicated generally by the numeral 70. This has a generally circular shape, that is with its internal portion principally cylindrical 82 and a corresponding outer surface 84 which is substantially cylindrical.

This sealing member can be made of a foamed plastic that has considerable compressibility, so that it can be deformed to fit variations in the contour of the wood surfaces. It is also molded with two grooves 86 adapted to fit over the tongues 18 of the log. It also has a provision of shelf surfaces 88 to match those of the log. Consequently, when it is placed over the log near the end such as shown in FIG. 5, where it is approximately centrally positioned over the cross log, such as 78, or the one that will be on top of 78, then the internal surface 80 of the log 74 will compress the sealing member 70 as shown in FIG. 4, and the compressed material will tightly fit all surfaces of the contact area between the two logs. Shown in FIG. 4 is a cross-section of the strip 70A, which will fit on top of log 74. Also shown in cross-section is the strip 38 corresponding to that of FIG. 2.

What has been described is a design of the top and bottom surfaces of a generally cylindrical log, of a selected diameter, which is combined with a plurality of such logs to build up vertical walls, and corner joints, of a log structure. In general, the preferred contact surface includes two parallel, spaced-apart, tapered tongues in the top surface, and corresponding grooves in the bottom surface. The shelf members between the tongue members and the groove members, and the outer surface of the log are slightly sloping downwardly and outwardly. The slope of the shelf members on the top of the logs is at a smaller angle A than the angle B of the shelf members on the bottom of the log. This relationship inherently provides a positive high-unit-pressure contact between the lips of the two contact surfaces, which provides a permanent, high-unit-pressure seal, for the restriction of entry of moisture into the joint.

The joint is further sealed by means of strips of formed material in the grooves, and/or plastic caulking material in the grooves and in the tapered cavities between the two shelves of the two logs.

While the preferred form of log contour is for two tongues in the top surface, and two grooves in the bottom surface, any other form can be used, such as a single tongue and groove, provided that the shelves are sloping, and the pressure of contact between logs is at the lips.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency by which each element thereof is entitled.

What is claimed is:

1. In a log for a log cabin, having a generally circular cross-section with upper and lower parallel flattened surfaces along the longitudinal length of said log, and having at least one tongue member extending upwardly from said upper surface, and having at least one groove member, substantially the reverse image of said at least one tongue member, extending inwardly and upwardly into said lower surface, the lateral portions of said first and second surfaces extending outwardly from said tongue members and said groove members to the outer circular portion of said log, defined as shelf members, the intersection of said shelf members with said circular portions defined as lips;

the improvement comprising;

(a) a first of said surfaces serving as said upper surface of said log, and the second of said surfaces serving as said lower surface of said log;

(b) the first shelf members of said first surface sloping outwardly and downwardly from the horizontal, by a selected small angle A from the outer walls of said tongues to the first lips of said first shelf members;

(c) the second shelf members of said second surface sloping outwardly and downwardly from the horizontal by a selected small angle B, where B is greater than A, to the second lips of said second shelf members;

whereby when said logs are positioned with their second surfaces on top of the first surfaces of the lower adjacent log, said tongues and grooves will mesh, and the logs will be supported at the contact of said first and second lips; and wherein any moisture that may be blown into the space between said first and second shelf members will be blocked by the walls of said tongues, and can migrate outwardly due to the slope of said upper shelf members.

2. The log as in claim 1 including at least two spaced parallel tongue members and at least two spaced parallel groove members.

3. The log as in claim 1 in which said first surface is the surface from which said tongues extend upwardly.

4. The log as in claim 1 in which said angle A is in the range of 2° to 3°, and the angle (B-A) is in the range of ½° to 1°, and said angle B is in the range of 2.5° to 4°.

5. The log as in claim 1 including a second log on top of a first log, and including;

(a) a strip of sealing material in at least one of the longitudinal cavities between the base of the groove and tops of the mating tongue.

6. The log as in claim 1 including;

(a) a molded strip of sealing material adapted to be placed transversely over the top of said log, near the end of said log;

(b) when in position the under surface of said strip will fit the upper contour of said log;

(c) and the upper surface of said strip will have a substantially semi-cylindrical contour;

whereby when a cross log, having a semi-cylindrical cavity in its under surface near one end, is positioned over said strip, the semi-cylindrical contour of said strip will fit the semi-cylindrical contour of said log, and will seal the opening therebetween.

7. The log as in claim 1 in which said upper and lower surfaces, said upper tongues and lower grooves, said upper and lower shelves are cut while the log is green.

8. The log as in claim 1, including a second log on top of a first log; and wherein said second log is supported on said first log at the contacts of said first and second lips; and including;

(a) sealing material positioned in at least one of the flat triangular cavities between said first and second shelf members.

9. The log as in claim 8 in which said sealing material comprises a plastic, deformable, non-drying, water-repellent material.

10. The log as in claim 8 in which said sealing material comprises a flexible, resilient, caulking material.

* * * * *